US006516698B1

(12) United States Patent
Poff, Jr.

(10) Patent No.: US 6,516,698 B1
(45) Date of Patent: Feb. 11, 2003

(54) MUZZLE BRAKE FOR FIREARM

(75) Inventor: Charles Richard Poff, Jr., Cape Coral, FL (US)

(73) Assignee: Cape AeroSpace, Cape Coral, FL (US)

( * ) Notice: Subject to any disclaimer, the term of this patent is extended or adjusted under 35 U.S.C. 154(b) by 0 days.

(21) Appl. No.: 10/004,121

(22) Filed: Oct. 31, 2001

(51) Int. Cl.[7] ..... F41A 21/00
(52) U.S. Cl. ..... 89/14.6
(58) Field of Search ..... 89/14.3, 14.6

(56) References Cited

U.S. PATENT DOCUMENTS

| | | | | | |
|---|---|---|---|---|---|
| 1,939,700 | A | | 12/1933 | Hofstetter | |
| 2,112,831 | A | | 4/1938 | Cutt, Jr. | |
| 2,322,370 | A | | 6/1943 | Lance | |
| 2,447,205 | A | | 8/1948 | Powell | |
| 2,451,514 | A | | 10/1948 | Sieg | |
| 2,668,479 | A | | 2/1954 | Batten | |
| 2,916,970 | A | | 12/1959 | Mutter | |
| 3,138,991 | A | | 6/1964 | Malter | |
| 3,164,060 | A | | 1/1965 | Dahl | |
| 3,187,633 | A | | 6/1965 | Tanabe | |
| 3,367,055 | A | | 2/1968 | Powell | |
| 3,533,325 | A | * | 10/1970 | Barr | 89/14.6 |
| 3,744,426 | A | * | 7/1973 | Butler | 102/527 |
| 3,837,107 | A | * | 9/1974 | Swaim et al. | 102/703 |
| 4,022,103 | A | * | 5/1977 | Schmidt | 89/14.2 |
| 4,385,561 | A | * | 5/1983 | Madderra | 102/523 |
| 4,446,771 | A | * | 5/1984 | Anthony et al. | 102/522 |
| 4,497,239 | A | * | 2/1985 | Curry | 102/432 |
| 4,534,265 | A | * | 8/1985 | Bates et al. | 89/14.6 |
| 4,656,919 | A | * | 4/1987 | Farinacci et al. | 89/14.6 |
| 4,753,152 | A | * | 6/1988 | Baechler | 188/371 |
| 5,105,717 | A | | 4/1992 | Pond | |
| 5,367,940 | A | | 11/1994 | Taylor | |
| 5,509,345 | A | | 4/1996 | Cyktich | |
| 5,528,974 | A | * | 6/1996 | Yoshida et al. | 73/12.11 |
| 5,814,757 | A | | 9/1998 | Buss | |
| 5,966,858 | A | * | 10/1999 | Curtis et al. | 42/1.14 |
| 6,223,642 | B1 | * | 5/2001 | O'Dwyer | 42/84 |

FOREIGN PATENT DOCUMENTS

| | | | |
|---|---|---|---|
| FR | 0812680 | * | 5/1937 |
| GB | 2190474 | | 11/1987 |
| IT | 0333851 | * | 9/1936 |
| JP | 403267699 | * | 11/1991 |
| SU | 001543949 | * | 1/1991 |

* cited by examiner

*Primary Examiner*—Michael J. Carone
*Assistant Examiner*—Troy Chambers
(74) *Attorney, Agent, or Firm*—Price, Heneveld, Cooper, DeWitt & Litton

(57) ABSTRACT

A firearm muzzle brake for utilization for a projectile surrounded by a sabot includes an outer housing, a baffle received within the outer housing and having a bore extending therethrough, and an inner core received within the bore of the baffle and having a bore extending therethrough. The bore of the core has a first section having a diameter that is adapted to allow a sabot to partially tear away from an associated projectile as the projectile and sabot travel through the first section of the bore of the core, and a second section having a second diameter that is adapted to hold the sabot in close contact with the projectile as the projectile travels through the second section of the bore of the core.

39 Claims, 3 Drawing Sheets

MUZZLE BRAKE FOR FIREARM

BACKGROUND OF THE INVENTION

The present invention relates to a muzzle brake for a firearm, and in particular to a muzzle brake adapted to strip a sabot from about an associated projectile.

Muzzle brakes are utilized with firearms in a wide variety of applications, such as flash and sound suppression as well as recoil dampening. These muzzle brakes typically include a plurality of holes extending from an inner cavity of the muzzle brake to an outer surface thereof and are designed to redirect gases caused by the ignition of a charge within the firearm.

Other kinds of muzzle attachments have focused on separating a sabot, or plastic housing, from about an associated projectile as the projectile travels through the attachment. Heretofore, these muzzle attachments have been directed at the concept of completely separating the sabot from the projectile prior to the projectile and sabot exiting the muzzle attachment. While these prior designs were effective for stripping the sabot from about the associated projectile, they are incompatible with today's modern firearms and ammunitions. Specifically, by causing the sabot to completely separate from the associated projectile while the projectile and sabot are still located within the muzzle brake, fragments of the sabot can disintegrate and lodge within the interior of the muzzle attachment, thereby rendering the muzzle attachment useless with respect to flash and noise suppression as well as recoil dampening, while causing the firearm to experience a severe degradation in accuracy, and causing mechanical failure of the muzzle brake.

A mechanism is therefore needed that combines the functions of a muzzle brake, such as noise and flash suppression as well as recoil dampening, with the function of stripping a sabot from an associated projectile, while simultaneously insuring the reliable operation of the muzzle brake and not causing a degradation in accuracy.

SUMMARY OF THE INVENTION

One aspect of the present invention is to provide a firearm muzzle brake for utilization with a projectile surrounded by a sabot, wherein the muzzle brake includes an outer housing, a baffle received within the housing and having a bore extending therethrough, and an inner core received within the bore of the baffle and having a bore extending therethrough. The bore of the core has a first section having a diameter that is adapted to allow the sabot to partially tear away from an associated projectile as the projectile and sabot travel through the first section of the bore of the core, and a second section having a second diameter that is adapted to hold the sabot separated from the longitudinal body of the projectile, while supporting the projectile's base, as the projectile travels through the second section of the bore of the core.

Another aspect of the present invention is to provide a firearm for delivering a projectile surround by a sabot, the firearm including a barrel having a longitudinally extending bore adapted to receive a projectile surrounded by a sabot, and a muzzle brake attached to the barrel and adapted to receive the projectile and the sabot therefrom. The muzzle brake includes an outer housing, a baffle received within the housing and having a bore extending therethrough, and an inner core received within the bore of the baffle and having a bore extending therethrough. The bore of the core has a first section having a diameter that is adapted to allow the sabot to partially tear away from the associated projectile as the projectile and the sabot travel through the first section of the bore of the core, and a second section having a second diameter that is adapted to hold the sabot separated from the longitudinal body of the projectile, while supporting the projectile's base, as the projectile travels through the second section of the bore of the core.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
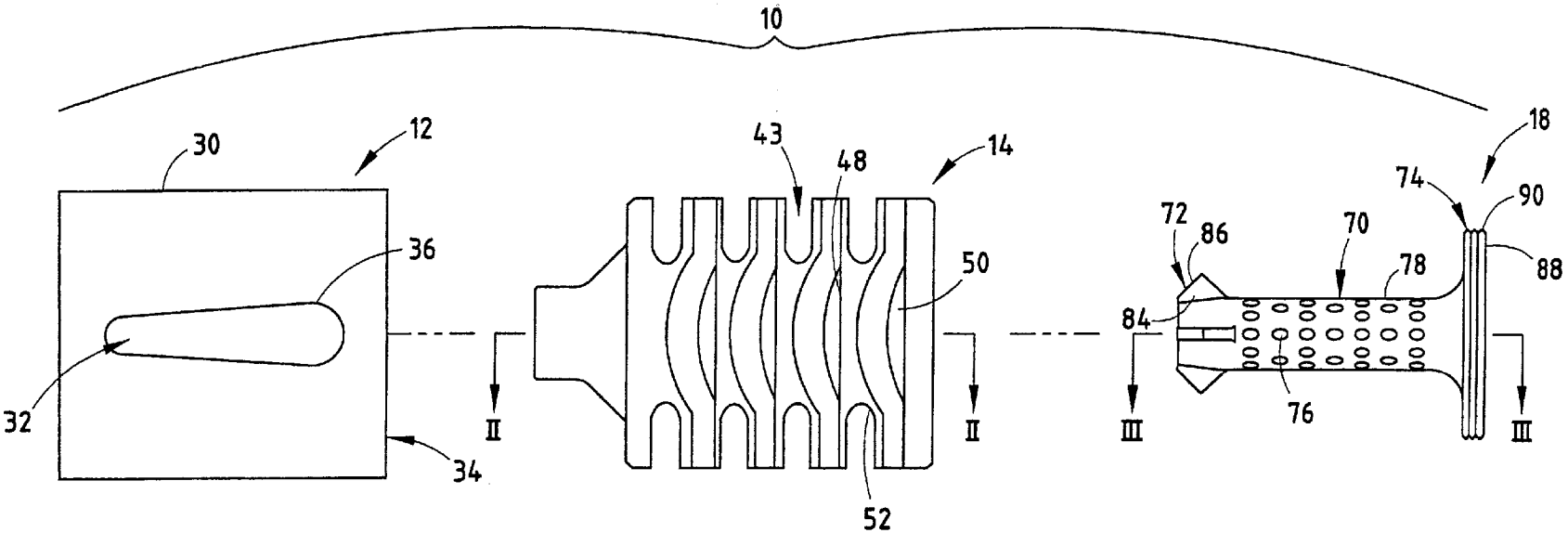
FIG. 1 is an exploded side elevational view of a muzzle brake embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
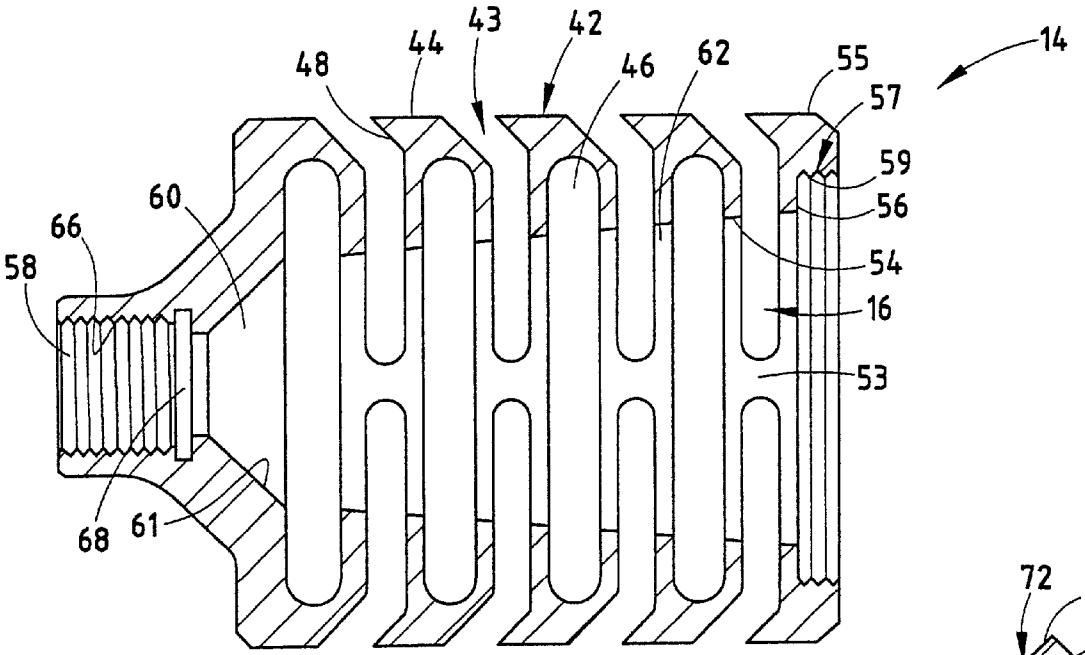
FIG. 2 is a cross-sectional side elevational view of a baffle of the muzzle brake, taken along the line II—II, of FIG. 1.
Figure 3:
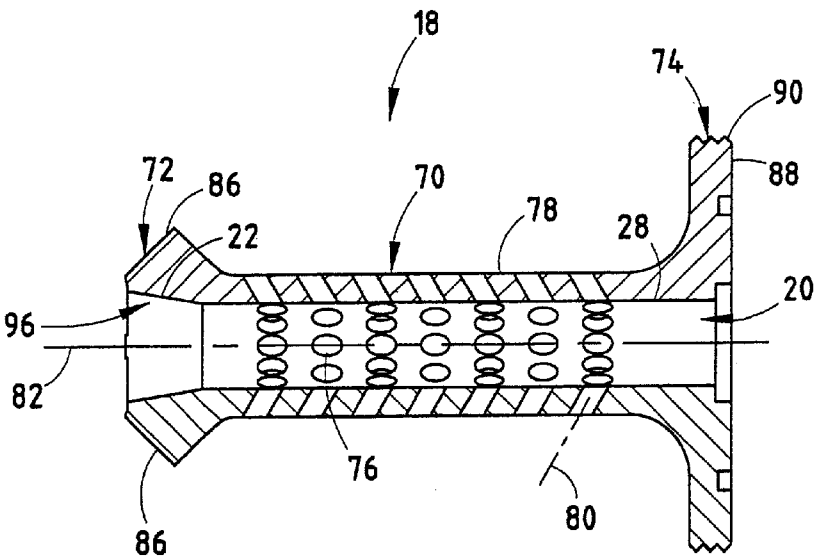
FIG. 3 is a cross-sectional side elevational view of a core of the muzzle brake, taken along the line III—III, of FIG. 1.

The reference numeral 10 (FIG. 1) generally designates a muzzle brake embodying the present invention. In the illustrated example, muzzle brake 10 includes an outer housing 12, a baffle 14 (FIG. 2) received within housing 12 and having a bore 16 extending therethrough, and an inner core 18 (FIG. 3) received within bore 16 of baffle 14 and having a bore 20 extending therethrough. Bore 20 of inner core 18 has a first section 22 having a diameter that is adapted to allow a sabot 24 (FIG. 4) to partially tear away from an associated projectile or bullet 26 as projectile 26 and sabot 24 travel through first section 22 of bore 20 of core 18, and a second section 28 having a second diameter that is adapted to hold sabot 24 in close contact with second section 28 of bore 20 of core 18, as discussed below.

The outer housing 12 (FIGS. 1 and 6) includes a cylindrically shaped outer wall 30 forming a cavity 32 therein and an aperture 34 at an end thereof. Outer wall 30 of housing 12 also includes a pair of elliptically shaped apertures extending therethrough and juxtaposed there across. Outer housing 12 further includes an end wall 38 having a centrally located aperture 40 extending therethrough. Outer housing 20 is preferably constructed of a corrosion resistant steel, however, other properties suitable for this application may be employed.

The baffle 14 (FIGS. 1 and 2) is cylindrically shaped and includes a plurality of radially outwardly extending rings 42 that define a cylindrically shaped outer surface 44 and a plurality of voids 43 therebetween. The diameter of outer surface 44 is configured so as to allow baffle 14 to be received within cavity 32 of housing 12. Each ring 42 has a disk-shaped hollow interior 46, and a pair of rearwardly extending, juxtaposed flanges 48. A plurality of apertures 50 extend from bore 16 of baffle 14 to an outer surface 52 of baffle 14, thereby allowing fluid communication between an interior of baffle 14 and ambient air surrounding baffle 14. Rings 46 are connected to one another via a pair of longitudinally extending, juxtaposed connection members 53 that extend between each of the rings 42. Bore 16 includes a first section 58, a second section 60, and a third section 62. An inner surface 54 of each of the rings 42 defines the conically shaped third section 62 bore 16 of baffle 14. The diameter of third section bore 16 of baffle 14 as defined by the inner surfaces 54 of each of the rings 42 increases while moving towards the forward end of baffle 14, thereby creating the conical shape. The most forward ring 55 has a step-profile recess 56 therein. Specifically, recess 56 is formed by a cylindrical wall 57 extending into the final ring 42, and having a plurality of threads 59 extending therealong. Second section 60 of bore 16 is defined by a conically shaped outer wall 61 and is located aft of first section 58 and rearwardly of third section 62. Third section 62 of bore 60 is cylindrically shaped and is adapted to receive a barrel 64 of an associated firearm therein. Specifically, third section 64 of bore 16 includes a plurality of threads 66 extending therealong and adapted to mate with similar threads on barrel 64. A stop ring 68 is seated between first section 58 and second section 60 of bore 16, and abuts an end of barrel 64 when muzzle brake 10 is secured thereto.

The inner core 18 (FIGS. 1 and 3) of muzzle brake 10 is generally cylindrically shaped and includes a central portion 70, a first end 72 and second end 74. Central portion 70 includes a plurality of gas ports 76 extending from bore 20 to an outer surface 78 of central portion 70. Each port is cylindrically shaped and includes a central axis 80. In the illustrated example, the central axis 80 of each port 76 is slanted with respect to a central axis 82 of bore 20 and forms an acute angle therewith. Specifically, each port 76 is rearwardly slanted towards first end 72 as the radial distance from central axis 82 of bore 20 increases. First end 72 of core 18 includes a plurality of triangularly shaped wings 84 each having a rearwardly facing abutment surface 86. Each surface 86 is adapted to abut inner wall 61 of second section 60 of bore 16 when core 18 is placed within baffle 14, thereby preventing end 72 of core 18 to move or vibrate axially. Second end 74 of core 18 includes a cylindrically shaped flange 88 having a plurality of threads 90 adapted to threadably mate with threads 59 of baffle 14. Bore 20 includes first section 22 and second section 28. First section 22 of bore 20 is provided a conical shape, wherein the entrance diameter, or the diameter closest to first end 72 is greater than the diameter in contact with second section 28 of bore 20. The conical shape of first section 22 provides an expansion zone 96 within which sabot 24 is allowed to partially tear away or separate from projectile 26 as described below.

Figure 4:
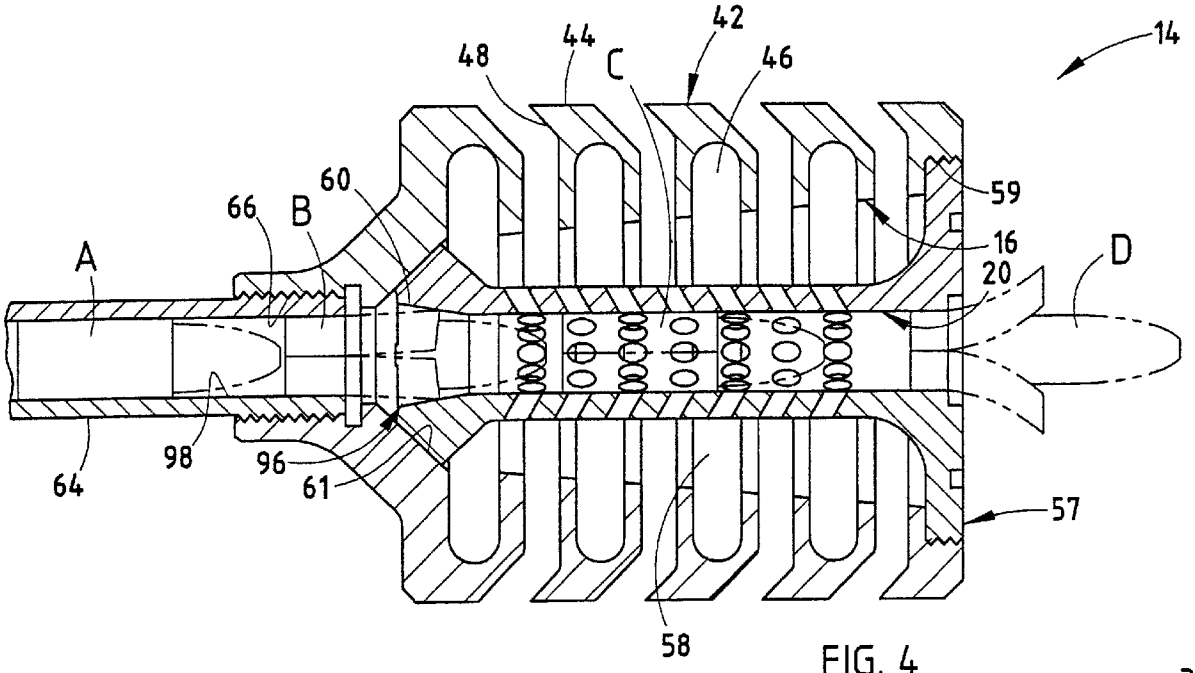
FIG. 4 is a cross-sectional side view of the muzzle brake, with a projectile and an associated sabot shown at several positions of travel.
Figure 5:
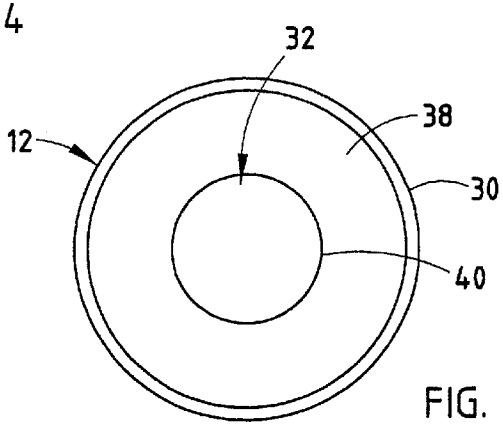
FIG. 5 is an end elevational view of a housing of the muzzle brake.

In assembly as best illustrated in FIG. 4, baffle 14 is placed within cavity 32 of housing 12 via aperture 34, such that outer surface 34 of rings 42 are in contact with outer wall 30 of housing 12 and a portion of baffle 14 extends through aperture 40 within end wall 38. Core 18 is placed within bore 16 of baffle 14 and threadably mated therewith via threads 90 of core 18 and threads 59 of baffle 14. Bore 20 is threadably mated within baffle 14 until surface 86 of each wing 84 abut inner wall 61 of second section 60 of bore 16. Muzzle brake 10 is attached to barrel 64 by threading the threaded end of barrel 64 into third section 62 of bore 16 of baffle 14 until an end of barrel 64 contacts stop ring 68. It should be noted that while the illustrated example threadably mates muzzle brake 10 with the associated barrel 64, other means of securing the muzzle brake 10 to barrel 64 may be utilized as known in the art.

In operation, a charge within the firearm is ignited thereby propelling projectile 26 and the associated sabot 24 along the bore 96 of barrel 64, as shown by position A. As sabot 24 and projectile 26 enter first section 22 of bore 20, sabot 24 is allowed to expand within expansion zone 96 and partially tear away from projectile 26, as shown by position B. Sabot 24 and projectile 26 subsequently enter second section 28 of bore 20 having a narrowed diameter that holds sabot 64 in close contact with the base of projectile 26, thereby preventing sabot 26 from separating completely from projectile 26 and disintegrating within muzzle brake 10, as shown by position C. As the projectile 26 exits bore 20 of core 18 the sabot 24 is completely torn away or removed from about projectile 26 in close proximity to muzzle brake 10, thereby increasing the accuracy of and distance traveled by projectile 26, as shown by position D.

As the projectile 26 and the associated sabot 24 travel through muzzle brake 10, the expanding gases traveling behind the projectile 26 and sabot 24 are in part ported through ports 76 of core 18. The rearward slant of ports 76 cause the expanding gas to push forwardly on the interior walls thereof, thereby creating a forward force on barrel 64 and the associated firearm and dampening the recoil as felt by the operator. The expanding gas subsequently travels from within bore 16 of baffle 14 into voids 43 between rings 42 via apertures 50. The redirection of the expanding gas through ports 76 of core 18 and between rings 42 of baffle 14 suppresses the flash as seen outside housing 12 as well as reduces the detectable sound. The expanding gas is subsequently ported from within housing 12 via apertures 36.

The present inventive firearm muzzle brake provides a durable design that can be easily and quickly assembled, is efficient to use, is capable of a long operating life, and is particularly well adapted for the proposed use. The firearm muzzle brake allows for adequate separation of the sabot from the associated projectile, thereby increasing accuracy of the projectile, while simultaneously providing noise and sound suppression as well as recoil dampening, and preventing degradation of these aspects by preventing the sabot from disintegrating within the muzzle brake.

In the foregoing description, it will be readily appreciated by those skilled in the art that modifications may be made to the invention within departing from the concepts disclosed herein. Such modifications are to be considered as included in the following claims, unless these claims by their language expressly state otherwise.

The invention claimed is:

1. A firearm muzzle brake for utilization with a projectile surrounded by a sabot, comprising:

an outer housing;

a baffle received within the housing and having a bore extending therethrough; and an inner core received within the bore of the baffle and having a bore extending therethough;

wherein the bore of the core has a first section having a diameter that is adapted to allow a sabot to partially tear away from an associated projectile as the projectile and the sabot travel through the first section of the bore of the core, and a second section having a second diameter that is adapted to hold the sabot in close contact with the projectile as the projectile and the sabot travel through the second section of the bore of the core.

2. The muzzle brake of claim 1, wherein the first section of the bore of the core is conically shaped and has a first end and a second end, the first end having a diameter that is greater than a diameter of the second end, and wherein the diameter of the second end is substantially similar to a diameter of the second section of the bore of the core.

3. The muzzle brake of claim 2, wherein the core has a first end and a second end, and wherein the first end of the core is in close contact with the bore of the baffle.

4. The muzzle brake of claim 3, wherein the core also has a plurality of ports extending between the bore and an outer surface.

5. The muzzle brake of claim 4, wherein the ports extending between the bore and the outer surface of the core each have a central axis, the bore of the core has a central axis, and wherein the central axis of at least some of the ports extending between the bore and the outer surface of the core form an acute angle with the central axis of the bore of the core.

6. The muzzle brake of claim 5, wherein at least some of the ports extending between the bore and the outer surface of the core are adapted to slant towards a barrel of an associated firearm as the radial distance from the central axis of the bore increases.

7. The muzzle brake of claim 6, wherein the baffle also has a plurality of ports extending between the bore and an outer surface of the baffle.

8. The muzzle brake of claim 7, wherein the baffle further has a plurality of longitudinally spaced-apart rings extending radially outward from the outer surface of the baffle.

9. The muzzle brake of claim 8, wherein the housing includes an outer wall having at least one aperture extending therethrough.

10. The muzzle brake of claim 9, wherein the at least one aperture within the outer wall of the housing includes a first aperture and a second aperture juxtaposed across the housing.

11. The muzzle brake of claim 10, wherein the bore of the baffle has a first section having a diameter adapted to be substantially similar to a diameter of a bore of a barrel of the firearm, and a second section adapted to receive the core therein.

12. The muzzle brake of claim 11, wherein the bore of the baffle has a third section adapted to removably attach with the barrel the firearm.

13. The muzzle brake of claim 12, wherein the third section of the bore of the baffle is adapted to receive the barrel therein.

14. The muzzle brake of claim 13, wherein the third section of the bore of the baffle is adapted to threadably receive the barrel therein.

15. The muzzle brake of claim 1, wherein the core has a first end and a second end, and wherein the first end of the core is in close contact with the bore of the baffle.

16. The muzzle brake of claim 1, wherein the core also has a plurality of ports extending between the bore and an outer surface.

17. The muzzle brake of claim 16, wherein the ports extending between the bore and the outer surface of the core each have a central axis, wherein the bore of the core has a central axis, and wherein the central axis of at least some of the ports extending between the bore and the outer surface of the core form an acute angle with the central axis of the bore of the core.

18. The muzzle brake of claim 17, wherein the ports extending between the bore and the outer surface of the core are adapted to slant towards a barrel of an associated firearm as the radial distance from the central axis of the bore increases.

19. The muzzle brake of claim 16, wherein the baffle also has a plurality of ports extending between the bore and an outer surface of the baffle.

20. The muzzle brake of claim 19, wherein the baffle further has a plurality of longitudinally spaced-apart rings extending radially outward from the outer surface of the baffle.

21. The muzzle brake of claim 19, wherein the housing includes an outer wall having at least one aperture extending therethrough.

22. The muzzle brake of claim 21, wherein the at least one aperture within the outer wall of the housing includes a first and second aperture juxtaposed across the housing.

23. The muzzle brake of claim 1, wherein the bore of the baffle has a third section adapted to removably attach with a barrel of a firearm.

24. The muzzle brake of claim 23, wherein the third section of the bore of the baffle is adapted to receive the barrel of the firearm.

25. The muzzle brake of claim 24, wherein the third section of the bore of the baffle is adapted to threadably receive the barrel of the firearm.

26. The muzzle brake of claim 1, wherein the second section of the bore of the core is adapted to hold the sabot in close contact with the projectile until the projectile has exited the bore of the core.

27. A firearm for delivering a projectile surrounded by a sabot, comprising:

a barrel having a longitudinally extending bore adapted to receive a projectile surrounded by a sabot;

a muzzle break attached to the barrel and adapted to receive the projectile and the sabot therefrom, the muzzle break comprising:

an outer housing;

a baffle received within the housing and having a bore extending therethrough; and an inner core received within the bore of the baffle and having a bore extending therethough;

wherein the bore of the core has a first section having a diameter that is adapted to allow the sabot to partially tear away from an associated projectile as the projectile and the sabot travel through the first section of the bore of the core, and a second section having a second diameter that is adapted to hold the sabot in close contact with the projectile as the projectile and the sabot travel through the second section of the bore of the core.

28. The firearm of claim 27, wherein the first section of the bore of the core is conically shaped and has a first end and a second end, the first end having a diameter that is greater than a diameter of the second end, and wherein the diameter of the second end is substantially similar to a diameter of the second section of the bore of the core.

29. The firearm of claim 27, wherein the core has a first end and a second end, and wherein the first end of the core is in close contact with the bore of the baffle.

30. The firearm of claim 29, wherein the core also has a plurality of ports extending between the bore and an outer surface.

31. The firearm of claim 30, wherein the ports extending between the bore and the outer surface of the core each have a central axis, the bore of the core has a central axis, and wherein the central axis of at least some ports extending between the bore and the outer surface of the core form an acute angle with the central axis of the bore of the core.

32. The firearm of claim 31, wherein at least some of the ports extending between the bore and the outer surface of the core slant towards the barrel of the firearm as the radial distance from the central axis of the bore increases.

33. The firearm of claim 30, wherein the baffle also has a plurality of ports extending between the bore and an outer surface of the baffle.

34. The firearm of claim 33, wherein the baffle further has a plurality of longitudinally spaced-apart rings extending radially outward from the outer surface of the baffle.

35. The firearm of claim 33, wherein the housing includes an outer wall having at least one aperture extending therethrough.

36. The firearm of claim 35, wherein the at least one aperture within the outer wall of the housing includes a first aperture and a second aperture juxtaposed across the housing.

37. The firearm of claim 27, wherein the bore of the baffle has a third section that is removably attached with the barrel.

38. The firearm of claim 37, wherein the third section of the bore of the baffle is adapted to receive the barrel therein.

39. The firearm of claim 38, wherein the third section of the bore of the baffle is adapted to threadably receive the barrel therein.

* * * * *